US008105114B2

(12) United States Patent
Kagotani

(10) Patent No.: US 8,105,114 B2
(45) Date of Patent: Jan. 31, 2012

(54) INTERMEDIATE ELECTRICAL CONNECTOR

(75) Inventor: Koichi Kagotani, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 253 days.

(21) Appl. No.: 12/568,019

(22) Filed: Sep. 28, 2009

(65) Prior Publication Data

US 2010/0081334 A1 Apr. 1, 2010

(30) Foreign Application Priority Data

Sep. 30, 2008 (JP) ..... 2008-253267

(51) Int. Cl.
*H01R 25/00* (2006.01)

(52) U.S. Cl. ..... 439/639

(58) Field of Classification Search ..... 439/639, 439/701

See application file for complete search history.

(56) References Cited

U.S. PATENT DOCUMENTS 6,918,774 B2 * 7/2005 Wu ..... 439/65
2003/0119362 A1 * 6/2003 Nelson et al. ..... 439/608

FOREIGN PATENT DOCUMENTS

JP 2005-216694 A 8/2005

* cited by examiner

*Primary Examiner* — Vanessa Girardi
(74) *Attorney, Agent, or Firm* — Kubotera & Associates, LLC

(57) ABSTRACT

An intermediate electrical connector for connecting two electrical connectors includes a blade assembly formed of a plurality of blades and a ground plate attached to the blades; a plurality of terminals disposed on each of the blades and extending in parallel to each other; and a holding member for holding the blade assembly. The intermediate electrical connector may further include an intermediate portion disposed between the holding members.

9 Claims, 8 Drawing Sheets

INTERMEDIATE ELECTRICAL CONNECTOR

BACKGROUND OF THE INVENTION AND RELATED ART STATEMENT

The present invention relates to an intermediate electrical connector for connecting two electrical connectors.

Patent Reference has disclosed a conventional intermediate electrical connector. According to Patent Reference, two electrical connectors as mating connectors are connected to each other through the conventional intermediate electrical connector from an upper direction (an upper connector) and a lower direction (a lower connector).

Patent Reference: Japanese Patent Publication No. 2005-216694

The conventional intermediate electrical connector includes a holding object. The holding object includes two secondary members situated at an upper side and a lower side thereof. The conventional intermediate electrical connector further includes a plurality of intermediate boards (blades) held by the two secondary members and a connecting member for connecting the two secondary members. The secondary member situated at the upper side may be referred to as "an upper secondary member", and the secondary member situated at the lower side may be referred to as "a lower secondary member".

The intermediate board includes a connecting portion for connecting to a plurality of terminals of an upper connector and a lower connector. The connecting portions are disposed at both of an upper edge and a lower edge of the intermediate board, respectively. The secondary member includes a plurality of retaining grooves penetrating therethrough in a lower to upper direction for retaining the intermediate board. The connecting member includes an upper engaging portion and a lower engaging portion having a hook shape, respectively. The secondary member further includes an arm portion for engaging the engaging portion in the lower to upper direction. The arm portion is provided on both of sidewall portions of the secondary member.

The intermediate electrical connector is assembled in a way described as follows. First, the lower engaging portion of the connecting member is engaged the arm portion of the lower secondary member in the upper to lower direction in order to attach the connecting member to both of the sidewall portions of the lower secondary member. Next, all of the intermediate boards are retained into the retaining grooves of the lower secondary member. Further, the upper engaging portion of the connecting member is engaged the arm portion of the upper secondary member in order to connect the upper secondary member to the lower secondary member through the connecting member. Thus the intermediate electrical connector is assembled.

In the conventional intermediate electrical connector disclosed in Patent Reference, when the intermediate electrical connector is assembled to be used, the plurality of the intermediate boards (blades) are retained in the retaining grooves of the lower secondary member one by one. As a result, it is necessary to repeat an operation of retaining the intermediate boards as many times as a number of the intermediate boards. Accordingly, a number of repeating the operation of retaining the intermediate board increases as the number of the intermediate boards increases. As a result, it takes longer time to retain the intermediate boards.

As described above, in the conventional intermediate electrical connector disclosed in Patent Reference, it requires a long period of time for assembling since the operation of retaining the intermediate board is performed as one of operations of assembling the intermediate electrical connector to be used.

In view of the problems described above, an object of the present invention is to provide an intermediate electrical connector capable of reducing the number of the operations of assembling in order to shorten an amount of time for assembling the intermediate electrical connector.

Further objects and advantages of the invention will be apparent from the following description of the invention.

SUMMARY OF THE INVENTION

In order to attain the objects described above, according to the present invention, an intermediate electrical connector for connecting two electrical connectors (mating connectors) includes a blade assembly formed of a plurality of blades and a ground plate attached to the blades; a plurality of terminals disposed on each of the blades and extending in parallel to each other; and a holding member for holding the blade assembly.

In the present invention, the terminals may be arranged on a first surface of each of the blades, and the ground plate is attached to a second surface of each of the blades opposite to the first surface.

In the present invention, the holding member may be arranged to hold the blade assembly at an edge portion of the blade assembly in a direction that the terminals extend.

In the present invention, the ground plate may be made of metal and have a plate shape.

In the present invention, the blade assembly having the plurality of the blades attached to the single ground plate has been already assembled when the intermediate electrical connector is assembled to be used. Thus, when the intermediate electrical connector is assembled, the plurality of the blades can be attached to the holding member at one time, with a simple operation of retaining the blade assembly having the plurality of the blades attached to the single ground plate to the holding member.

In the present invention, the holding member may include a retaining portion for holding an edge portion of the blade assembly. It is preferable that the blade assembly includes an engaging portion disposed on the ground plate to be retained in the retaining portion and that the retaining portion includes an engaged portion on an inner surface thereof for engaging the engaging portion.

When the edge portion of the blade assembly is retained in the retaining portion of the holding member, the engaging portion of the ground plate of the blade assembly engages the engaged portion of the retaining portion of the holding member in the direction that the terminals extend. Therefore, it is possible to prevent the blade assembly from coming off from the holding member.

In the present invention, it is preferable that the blade assembly includes the edge portion tightly fitted in the retaining portion of the holding member. The blade assembly can be fixed to the holding member since the edge portion thereof is fitted tightly in the retaining portion of the holding member. Accordingly, it is possible to determine positions of the blade assembly against the holding member.

In the present invention, the holding member may include a first holding member and a second holding member for holding both edge portions of the blade assembly.

Further, in the present invention, the intermediate electrical connector may include an intermediate portion disposed between the first holding member and the second holding member for covering the blade assembly.

In a case that the intermediate electrical connector does not include the intermediate portion, the holding members hold only the edge portions of the blade assembly. Thus, the terminals and the ground plate of the blade assembly are exposed. As a result, the terminals and the ground plate may be touched with a finger or have a foreign object adhered thereto when the intermediate electrical connector is connected to mating connectors.

In the present invention, the intermediate portion is disposed between the holding members and covers the blade assembly. Accordingly, the blade assembly does not have to be touched with a finger nor have a foreign object adhered thereto when the intermediate electrical connector is connected to the mating connectors. Therefore, it is also preferable, in an electrical point of view, that the intermediate electrical connector includes the intermediate portion.

In the present invention, the blade assembly having the plurality of the blades attached to the single ground plate has been already assembled when the intermediate electrical connector is assembled to be used. Thus, when the intermediate electrical connector is assembled, the plurality of the blades can be attached to the holding member at one time, with a simple operation of retaining the edge portion of the blade assembly having the plurality the blades and the single ground plate to the holding member. As a result, it is possible to shorten an amount of time required to assemble the intermediate electrical connector substantially, since a number of the operations of attaching the blades can be reduced as compared to a case that the blades are retained in the holding member one by one in the conventional intermediate electrical connector.

BRIEF DESCRIPTION OF THE DRAWINGS

FIGS. 4(A) and 4(B) are perspective views showing a blade according to the embodiment of the present invention, wherein FIG. 4(A) is a perspective view showing the blade from a side thereof where terminals are disposed, and FIG. 4(B) is a perspective view showing the blade from a side thereof where a ground plate is attached, that is, from an opposite side to the side thereof where the terminals are disposed;

FIGS. 7(A) and 7(B) are sectional views showing the connector according to the embodiment of the present invention, wherein FIG. 7(A) is a sectional view showing the connector taken along a line 7(A)-7(A) in FIG. 2(A) and FIG. 7(B) is a sectional view showing the connector taken along a line 7(B)-7(B) in FIG. 2(A).

DETAILED DESCRIPTION OF THE PREFERRED EMBODIMENTS

Hereunder, an embodiment of the present invention will be explained with reference to the accompanying drawings.

Figure 1:
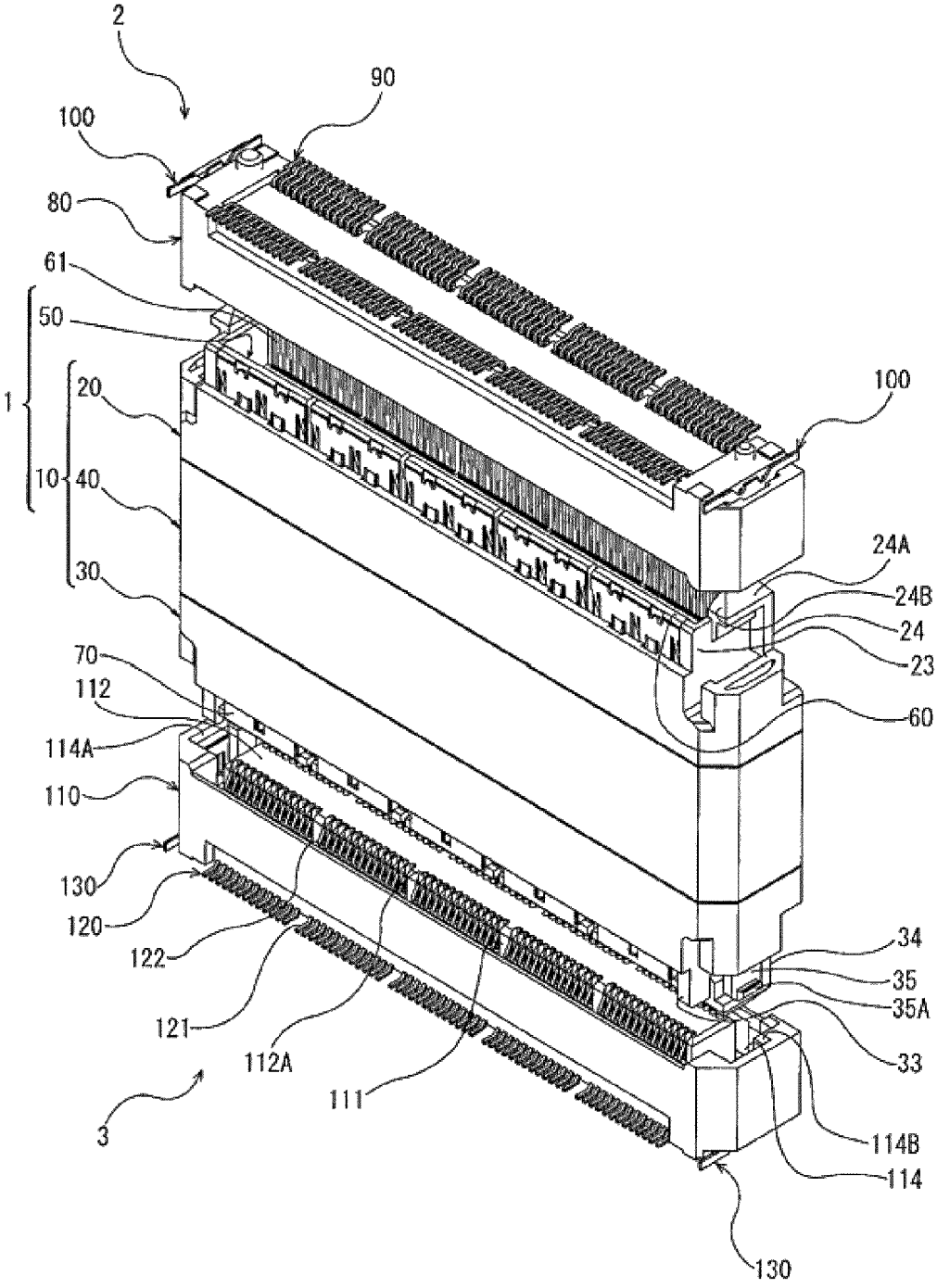
FIG. 1 is a perspective view showing an electrical intermediate connector (a connector) along with an upper connector and a lower connector as meting connectors according to an embodiment of the present invention.

FIG. 1 is a perspective view showing an electrical intermediate connector according to an embodiment of the present invention, along with two electrical connectors as mating connectors, to be connected to each other through the electrical intermediate connector, in a state before connecting to the electrical intermediate connector.

Figure 2A:
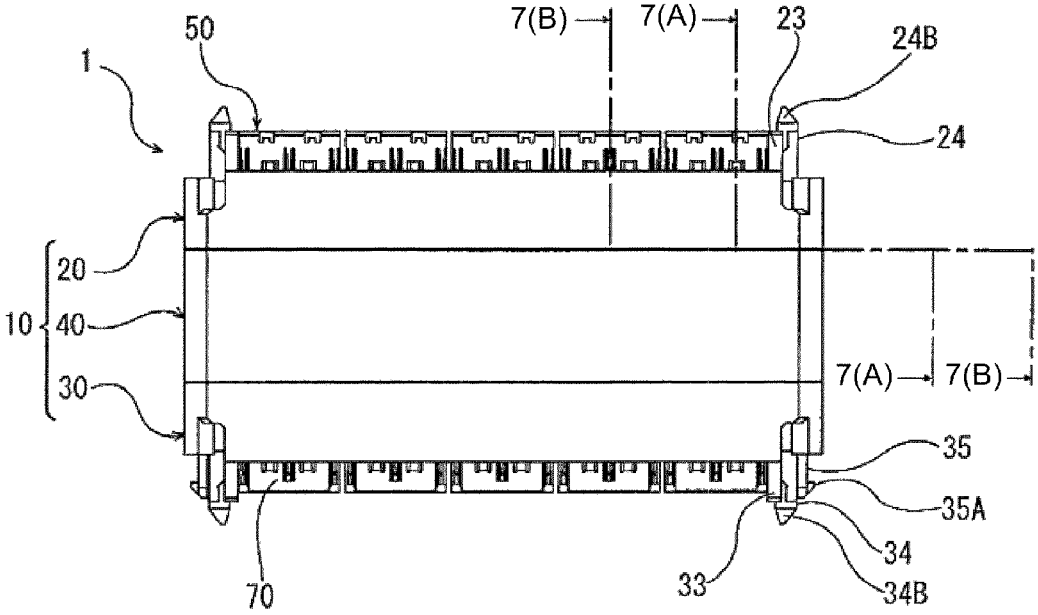
FIG. 2(A) is a front view showing the connector according to the embodiment of the present invention.
Figure 2B:
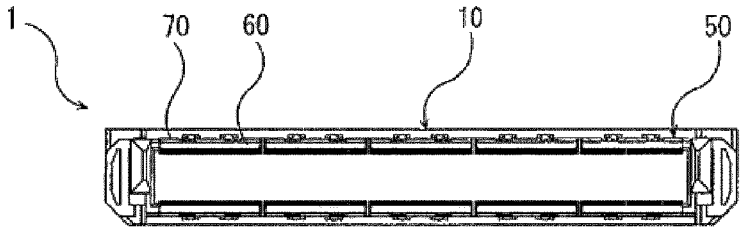
FIG. 2(B) is a plan view showing the connector according to the embodiment of the present invention.
Figure 2C:
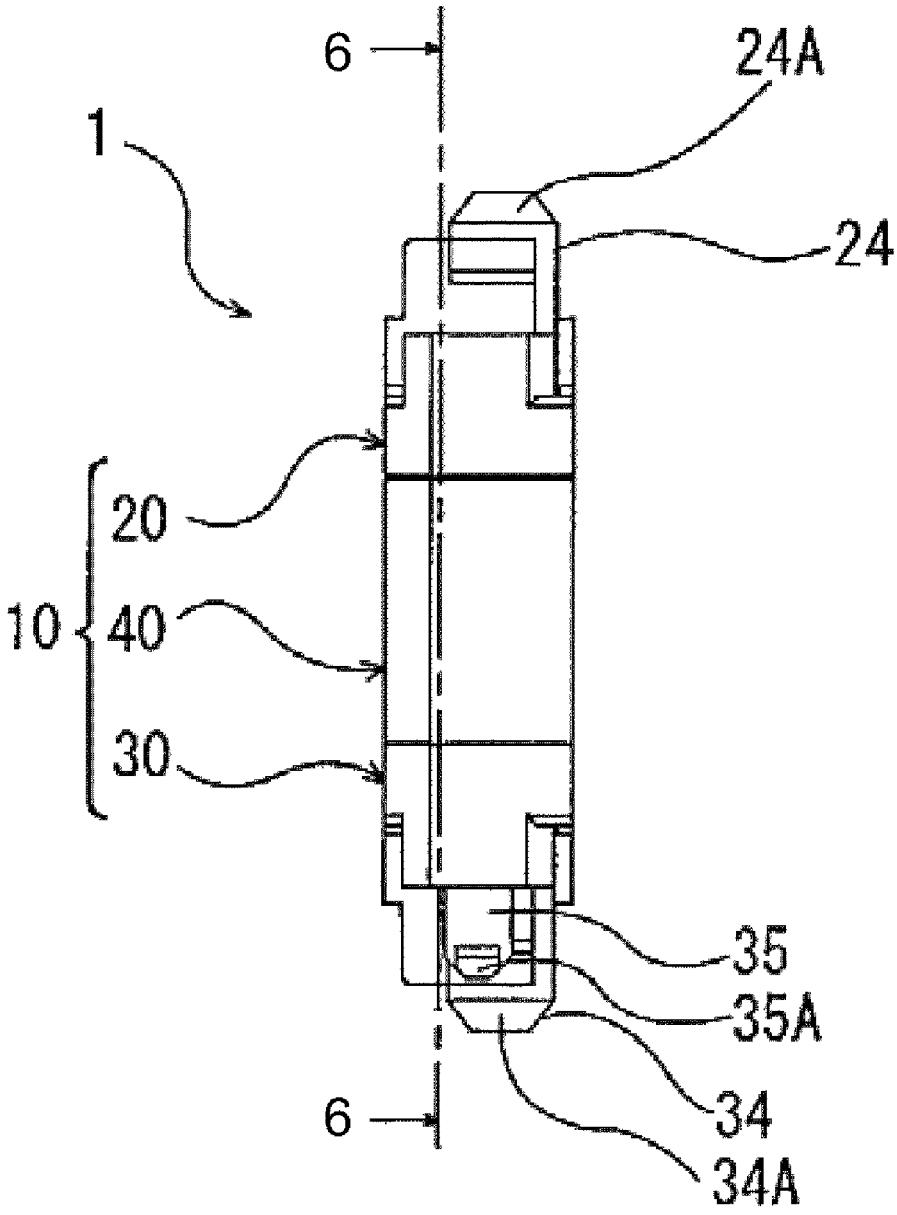
FIG. 2(C) is a side view showing the connector according to the embodiment of the present invention.

FIGS. 2(A), 2(B) and 2(C) are views showing the electrical intermediate connector, wherein FIG. 2(A) is a front view thereof; FIG. 2(B) is a plan view thereof; and FIG. 2(C) is a side view thereof. The intermediate electrical connector 1 (a connector 1) is connected to an electrical connector 2 or an upper connector 2 situated an upper side thereof in FIG. 1 through an upper edge portion thereof. The connector 1 is also connected to an electrical connector 3 or a lower connector 3 situated a lower side thereof in FIG. 1 through a lower edge portion thereof. In the embodiment, the upper connector 2 and the lower connector 3 are described as "mating connectors 2 and 3" when it is not necessary to distinguish therebetween.

In the embodiment, the mating connectors 2 and 3 are connectors to be mounted on a circuit board. Each of the mating connectors 2 and 3 is mounted on a different circuit board (not shown). Both of the circuit boards are connected electrically in a state of extending in parallel to each other, when the mating connectors 2 and 3 are connected to the connector 1, respectively.

Figure 4A:
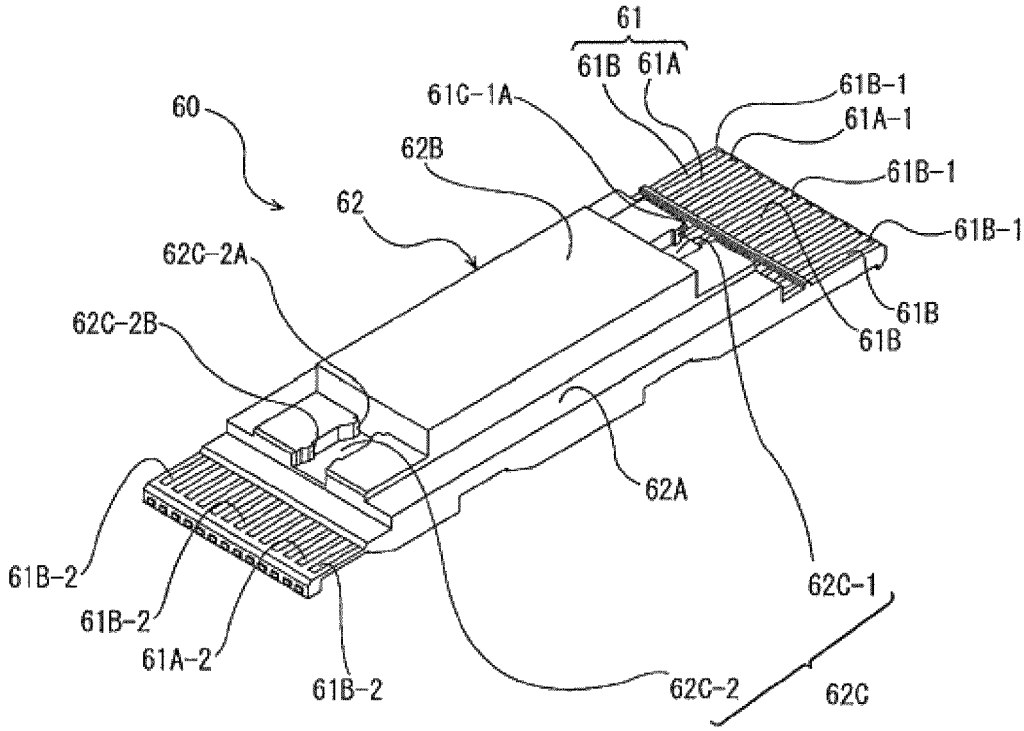
Figure 4B:
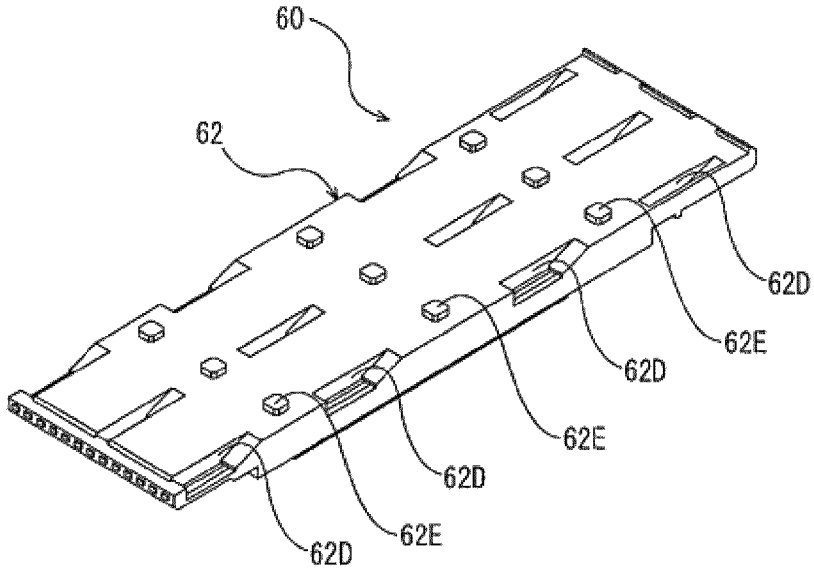

As shown in FIGS. 1 and 4(A)-4(B), the connector 1 includes a housing 10 made from a synthetic resin; and two blade assemblies 50 with a plate shape being held with the housing 10. The housing 10 includes an upper holding member 20 for holding an upper edge portion of the blade assembly 50 in FIG. 1; a lower holding member 30 for holding a lower edge portion of the blade assembly 50; and an intermediate portion 40 disposed between the upper holding member 20 and the lower holding member 30 for covering the blade assembly 50. As shown in FIGS. 1, 2(A) and 2(C), the upper holding member 20, the lower holding member 30 and the intermediate portion 40 are disposed so as to abut against each other in an upper to lower direction.

As shown in FIGS. 1 and 2(B), the two blade assemblies 50 are held in the housing 10 such that plate surfaces thereof face each other in a thickness direction of the connectors, that is, a direction perpendicular to both of a width direction (a horizontal direction in FIG. 1) and a height direction (a vertical direction in FIG. 1) of the connector 1 and the mating connectors 2 and 3 (the connectors).

Figure 3:
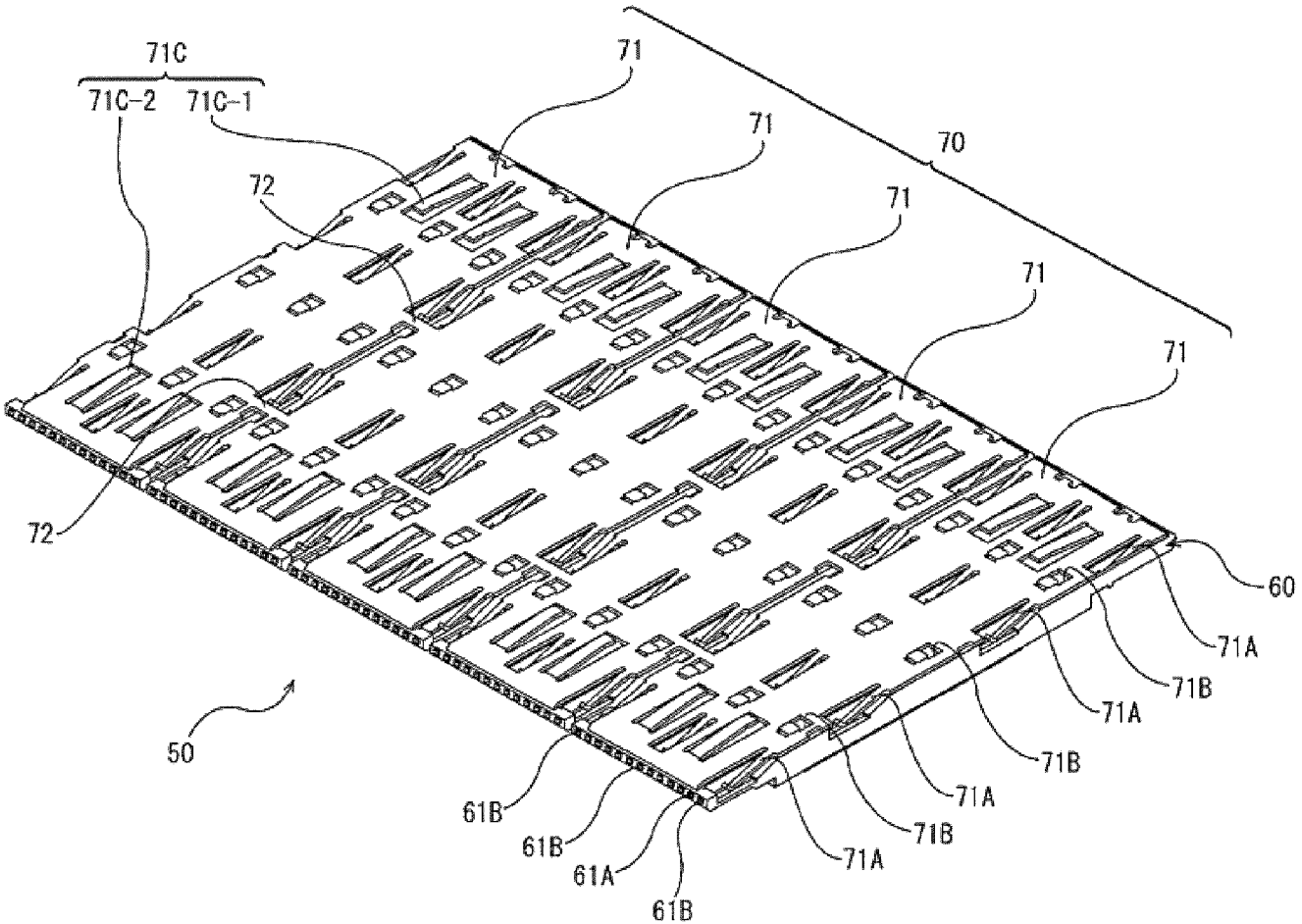
FIG. 3 is a perspective view showing a blade assembly according to the embodiment of the present invention.

As shown in FIG. 3, as described later, the blade assembly 50 includes a plurality of blades 60 having a plurality of terminals 61 extending and being disposed in parallel to each other; and a ground plate 70 attached to the blades 60. The ground plate 70 is made from metal and has a plate shape.

As shown in FIG. 1, in the blade assembly 50, the plurality of the blades 60 is disposed next to each other in the width direction of the connectors, and the terminals 61 extend in the height direction of the connectors. Accordingly, the plurality of the blades 60 is disposed so as to situate on a plane extending in the width direction and the height direction of the connectors. Consequently, the plurality of the terminals 61 is disposed in the width direction of the connectors.

Figure 5:
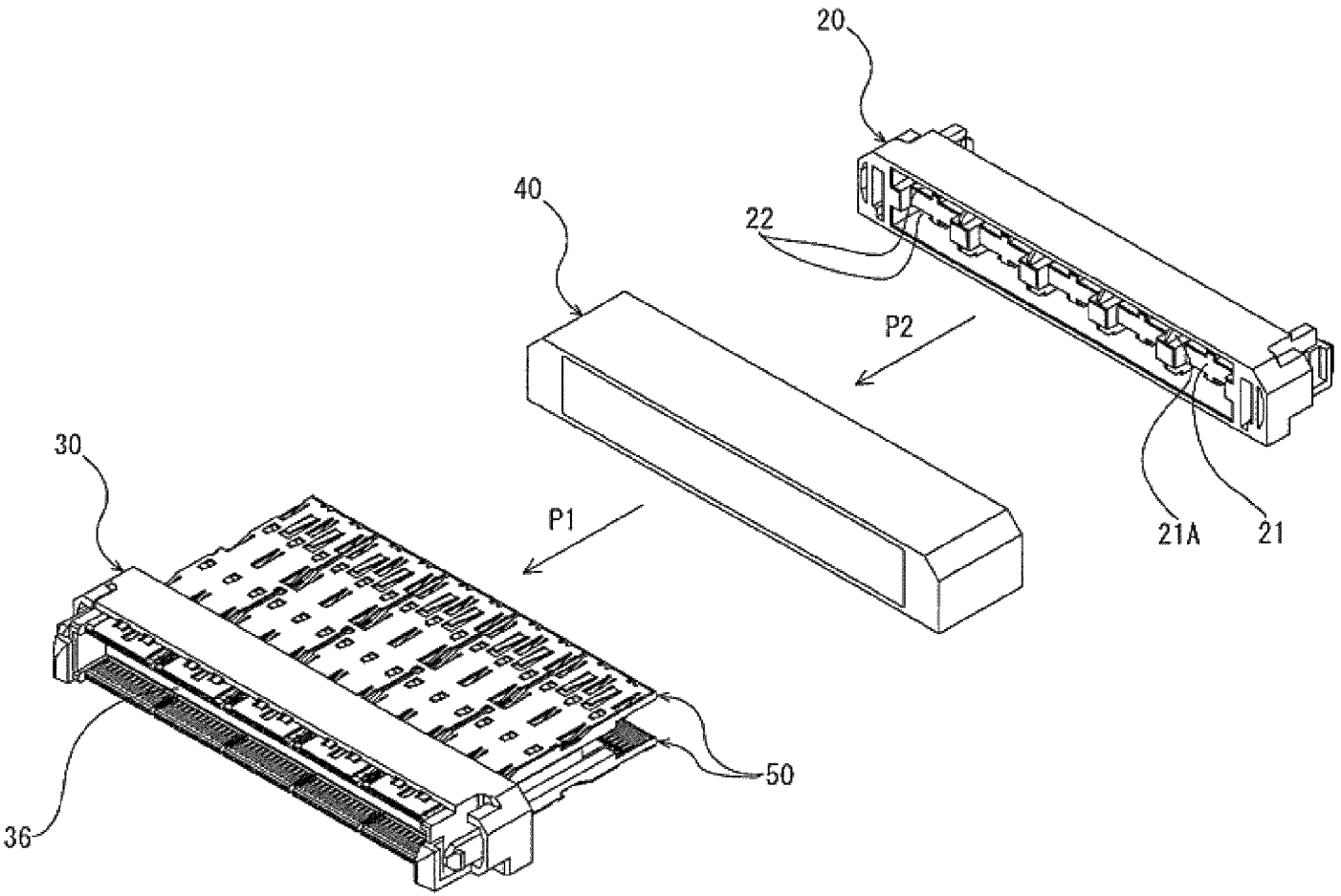
FIG. 5 is a perspective view showing a process of assembling the connector according to the embodiment of the present invention.

The upper holding member 20 has an approximate rectangular shape extending in the width direction of the connectors, or a terminal disposing direction. The upper holding member 20 includes an opening penetrating therethrough in the height direction of the connectors for holding the upper edge portions of the two blade assemblies 50. As shown in FIG. 5, the opening is separated into two retaining portions 22 (not shown) with a separating wall portion 21 situated at a central position in the thickness direction of the connectors. Further, each of the retaining portions 22 is divided with spaces as many as a number of the blades 60 disposed in the blade assembly 50 in the width direction of the connectors with a separating portion 21A extending from both wall surface of the separating wall portion 21 in the thickness direction of the connectors.

Figure 6:
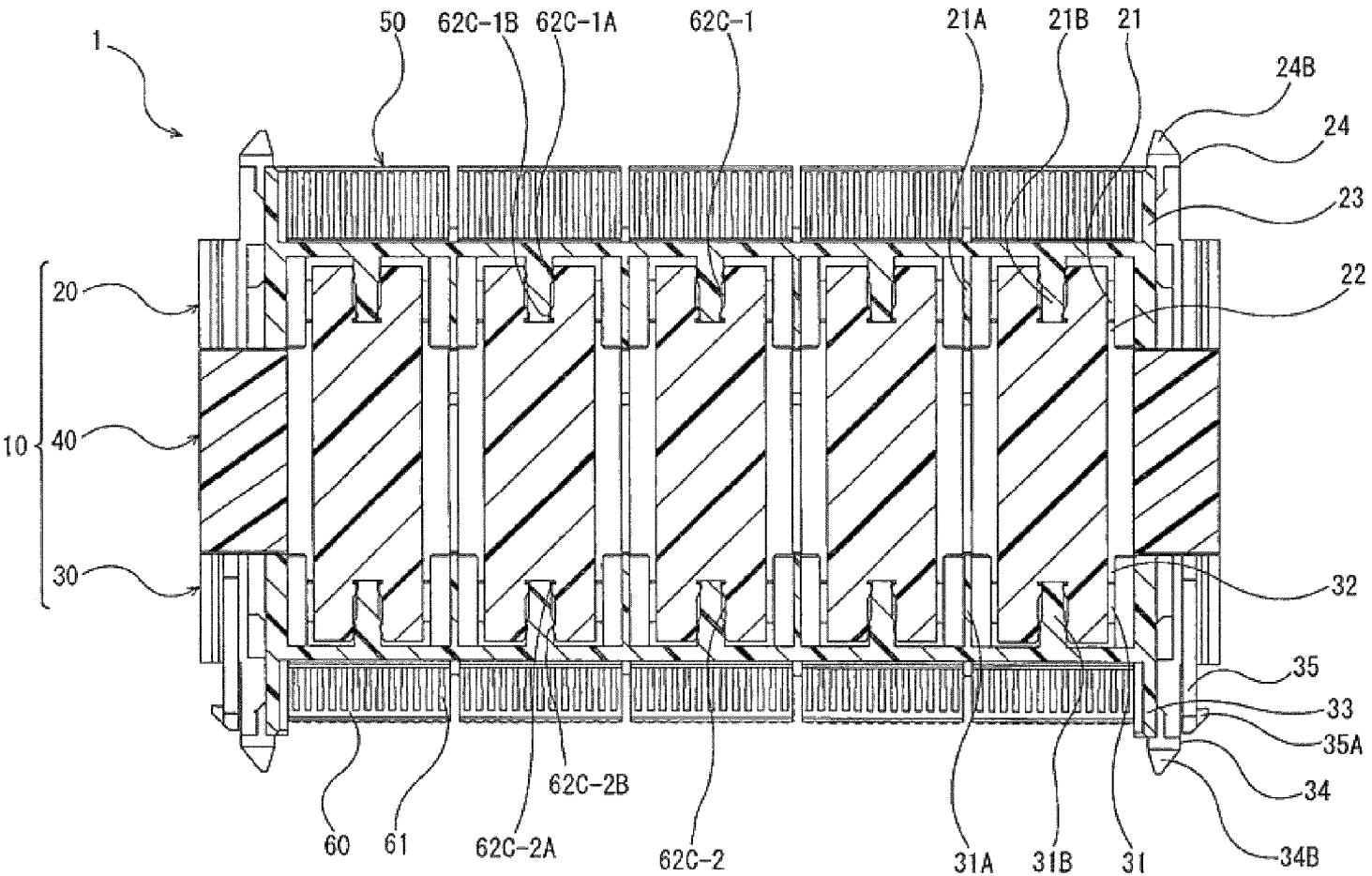
FIG. 6 is a sectional view showing the connector taken along a line 6-6 in FIG. 2(C) according to the embodiment of the present invention.

As shown in FIGS. 5 and 6, the separating wall portion 21 includes a plurality of elongated protruding portions 21B for holding the blade 60 on wall surfaces of both sides thereof. The elongated protruding portions 21B are aligned with intervals in the width direction of the connectors, and each of the elongated protruding portions 21B extends in the height direction of the connectors. As described later, the elongated protruding portion 21B is pressed into a holding groove 62C (described later) of the blade 60 of the blade assembly 50 in order to hold the blade assembly 50 when the blade assembly 50 is inserted into the retaining portion 22 from a lower direction.

As shown in FIGS. 1 and 2(A), the upper holding member 20 further includes an end wall portion 23. The end wall portion 23 is situated at both ends of the upper holding member 20 in the width direction of the connectors and extends from an upper end portion of the upper holding member 20 in an upper direction. The upper holding member 20 further includes a guiding portion 24 formed next to the end wall portion 23. The guiding portion 24 is also situated outside the end wall portion 23 in the width direction of the connectors. The guiding portion 24 extends in the upper direction further than the end wall portion 23. The guiding portion 24 protrudes an upper end portion thereof in the upper direction further than the end wall portion 23. The upper end portion of the guiding portion 24 has a tapered shape in the upper to lower direction. The tapered shape includes guiding surfaces 24A and 24B for guiding the upper connector 2 to a right connecting position when the upper connector 2 is connected to the connector 1.

The guiding surface 24A has a slope in the width direction of the connectors, while the guiding surface 24B has a slope in the thickness direction of the connectors. Accordingly, the guiding surface 24A guides the upper connector 2 to the right connecting position in the width direction of the connectors, while the guiding surface 24B guides the upper connector 2 to the right connecting position in the thickness direction of the connectors. In addition, the upper holding member 20 includes a lower end surface as a flat surface for abutting against the intermediate portion 40.

The lower holding member 30 has an upside-down shape of the upper holding member 20 basically, except for having a hook portion 35 (described later). Accordingly, an explanation about a configuration of the lower holding member 30 is omitted. Numbers assigned to portions of the lower holding member 30 are the numbers added ten to the numbers assigned to corresponding portions of the upper holding member 20.

As described later, a portion 34 of the lower holding member 30 corresponding to the guiding portion 24 of the upper holding member 20 works as a guided portion 34 to be guided by a guiding portion 114 of the lower connector 3 when the connector 1 is connected to the lower connector 3.

As described above, the lower holding member 30 differs from the upper holding member 20 in including the hook portion 35. The hook portion 35 engages the lower connector 3 when the connector 1 is connected to the lower connector 3. As shown in FIG. 1, the hook portion 35 is situated outside the guided portion 34 in the width direction of the connectors. The hook portion 35 has a plate shape formed as a cantilever and capable of an elastic displacement in the width direction of the connectors. The hook portion 35 includes an engaging claw 35A at a tip portion thereof. The engaging claw 35A protrudes toward an outside the connector 1 in the width direction of the connectors.

When the connector 1 is connected to the lower connector 3, the engaging claw 35A of the hook portion 35 engages an engaged portion (not shown). The engaged portion is formed as a tiered portion in an inner surface of a housing of the lower connector 3 in the height direction of the connectors or a connecting direction of the connectors. Thus it is possible to prevent the connector 1 from coming off from the lower connector 3.

The intermediate portion 40 extends in the width direction of the connectors, and has a tube like shape penetrating in the height direction of the connectors. The intermediate portion 40 further includes flat surfaces at an upper end surface and a lower end surface thereof. The upper end surface and the lower end surface of the intermediate portion 40 abut against the upper holding member 20 and the lower holding member 30, respectively. Therefore, as shown in FIGS. 2(A) and 2(B), the upper end surface of the intermediate portion 40 is attached closely to the lower end surface of the upper holding member 20, and the lower end surface of the intermediate portion 40 is attached closely to the upper end surface of the lower holding member 30. The intermediate portion 40 is not necessarily a required portion for the connector 1.

FIG. 3 is a perspective view showing the blade assembly 50. FIGS. 4(A) and 4(B) are perspective views showing the blade 60 of the blade assembly 50 in a state before the ground plate 70 is attached thereto. FIG. 4(A) is a perspective view showing the blade 60 from a side thereof where terminals are disposed, and FIG. 4(B) is a perspective view showing the blade 60 from a side thereof where the ground plate 70 is attached, that is, from an opposite side to the side thereof where the terminals are disposed. As shown in FIG. 3, the blade assembly 50 is configured with the plurality of the blades 60 being attached to the ground plate 70. The ground plate 70 is made from metal and has a plate shape.

As shown in FIG. 4(A), the blade 60 includes the plurality of the terminals 61 disposed in parallel to each other with predetermined intervals. The blade 60 is formed integrally with the terminals 61 thus aligned and an insulating plate 62 made from a synthetic resin. In the embodiment, the terminals 61 are disposed with equal intervals. The terminal 61 exposes both ends in a longitudinal direction thereof on a plate surface of the insulating plate 62, and a middle portion thereof in the longitudinal direction thereof is embedded inside the insulating plate 62.

The plurality of the terminals 61 of the blade 60 includes a signal terminal 61A and a ground terminal 61B. The signal terminal 61A and the ground terminal 61B have the same shape. As shown in FIG. 4(A), in the embodiment, among the terminals 61 of the blade 60, the terminals 61 situated at a center and both ends work as the ground terminal 61B. The rest of the terminals 61 of the blade 60 works as the signal terminals 61A. In the embodiment, the signal terminal 61A and the ground terminal 61B may be referred to as "terminal 61" inclusively, in a case there is no need to distinguish between the signal terminal 61A and the ground terminal 61B.

The signal terminal 61A and the ground terminal 61B include upper contacting portions 61A-1 and 61B-1 at one end thereof (an end of right side in FIG. 4(A)) for contacting with the upper connector 2, and lower contacting portions 61A-2 and 61B-2 at another end thereof for contacting with the lower connector 3, respectively.

As shown in FIG. 4(A), the insulating plate 62 includes a covering portion 62A for covering partially surfaces the terminals 61 thus disposed, or a terminal disposing surface, a virtual plane including both planes where the terminals 61 are buried and exposed. The covering portion 62A covers the middle portions of the terminals 61 in the longitudinal direction of the terminals 61. The covering portion 62A includes a block portion 62B with a block shape in a central portion thereof in the terminal disposing direction. The block portion 62B is partially cut out and has a step like shape at both ends thereof in the longitudinal direction of the terminal 61.

The block portion 62A further includes a holding groove 62C at both ends thereof in the longitudinal direction of the terminal 61. The holding groove 62C is situated a central portion in the terminal disposing direction and extends in the longitudinal direction of the terminal 61. The holding groove 62C holds the elongated protruding portion 21B of the upper holding member 20 and an elongated protruding portion 31B of the lower holding member 30. In the embodiment, the holding groove 62C situated on a side of the upper contacting portions 61A-1 and 61B-1 is referred to as an upper holding groove 62C-1, and the holding groove 62C situated on a side of the lower contacting portions 61A-2 and 61B-2 is referred to as an upper holding groove 62C-2.

In addition, as shown in FIG. 4(A), the upper holding groove 62C-1 includes holding protruding portions 62C-1A and 62C-1B at an upper portion and a lower portion thereof, respectively. Each of the holding protruding portions 62C-1A and 62C-1B is a pair of protrusions facing each other provided on a pair of side surfaces of the upper holding groove 62C-1, facing and extending in parallel to each other in the longitudinal direction of the terminal 61. In a similar way, the lower holding groove 62C-2 includes holding protruding portions 62C-2A and 62C-2B at an upper portion and a lower portion thereof, respectively. Each of the holding protruding portions 62C-2A and 62C-2B is a pair of protrusions facing each other provided on a pair of side surfaces of the lower holding groove 62C-2, facing and extending in parallel to each other in the longitudinal direction of the terminal 61.

As shown in FIG. 4(A), the blade 60 includes a recess portion 62D in an opposite surface of the terminal disposing surface thereof, that is, in a surface where the ground plate 70 is attached or an attached surface. The recess portion 62D allows a ground piece 71A (described later) of the ground plate 70 to enter. The recess portion 62D is provided at a position corresponding to the ground piece 71A of the ground plate 70. More specifically, the recess portions 62D are provided at four locations in the longitudinal direction of the terminals 61 in each of both end portions and the central portion on the terminal disposing surface.

As shown in FIG. 4(B), the recess portion 62D includes a sloping surface having a slope along a slope of the corresponding ground piece 71A. The ground terminal 61B is exposed in a bottom surface of the recess portion 62D. Further, the blade 60 includes a protruding portion 62E on the attached surface thereof at a position corresponding to an attaching hole portion 71B (described later) of the ground plate 70. In other words, the protruding portion 62E is provided between the recess portions 62D in the longitudinal direction of the terminal 61. The protruding portion 62E has a box cross-sectional shape. A process of attaching the ground plate 70 onto the blade 60 will be described later.

The ground plate 70 includes a unitary ground plate 71 corresponding to an area of single one of the blades 60. The ground plate 70 is configured by combining the unitary ground plates 71 as many as a number of the blades 60 in the terminal disposing direction, with connecting portions 72 (described later) having a narrow shape in between. Thus the ground plate 70 is formed as a single metal plate. In the embodiment, a configuration of single one of the unitary ground plates 71 will be explained since all of the unitary ground plates 71 have the same configuration. Accordingly, an explanation of the other of the unitary ground plates 71 is omitted.

The unitary ground plate 71 has a plate surface corresponding to the attached surface of the blade 60. The unitary ground plate 71 includes a ground piece 71A cut and bent toward the blade 60. The ground pieces 71A are provided at four locations in the longitudinal direction of the terminal 61 on each of both end portions and a central portion of the unitary ground plate 71 in the terminal disposing surface. In the embodiment, the ground terminal 61B is situated at a corresponding position to the ground piece 71A. The ground piece 71A has a shape like an arm. As shown in FIG. 3, each of the ground pieces 71A extends toward the lower contacting portions 61A-2 and 61B-2 in the longitudinal direction of the terminal 61.

Figure 7A:
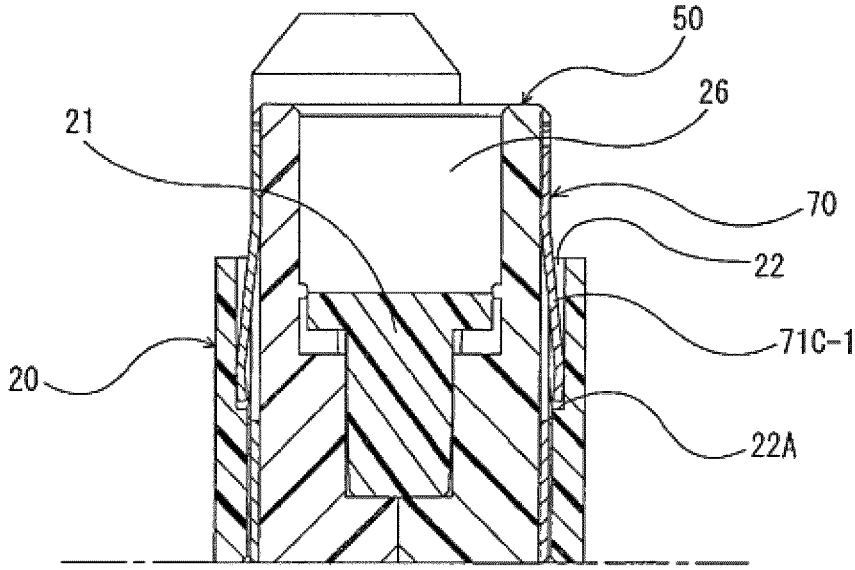
Figure 7B:
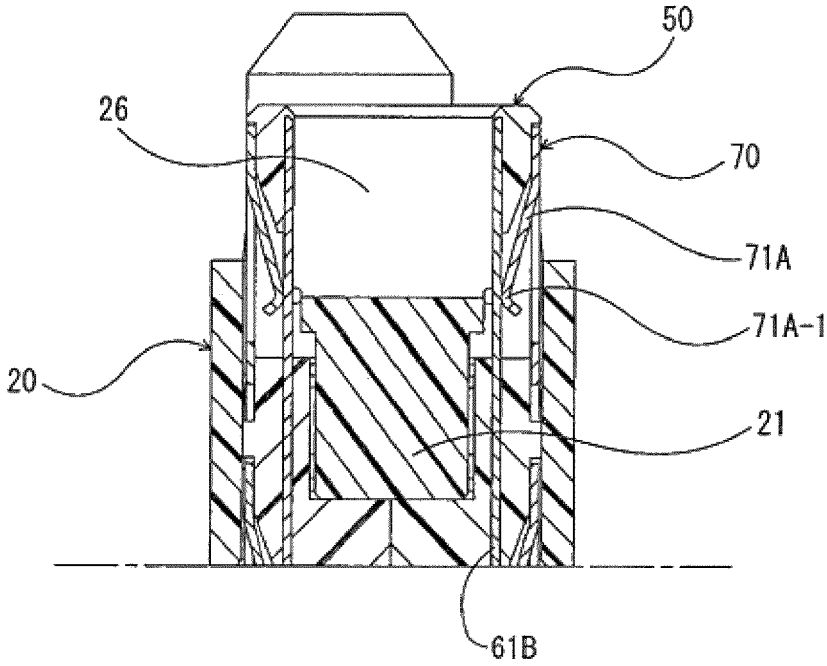

As shown in FIG. 7(B), the ground piece 71A includes a contact portion 71A-1 for contacting with the ground terminal 61B. The contact portion 71A-1 is provided by bending a forefront portion of the ground piece 71A convexly, so as to confront to the plate surface of the insulating plate 62 and to enter the recess portion 62D of the blade 60. Thereby, the ground piece 71A contacts with the ground terminal 61B elastically at the contact portion 71A-1 thereof. As a result, the connector 1 is able to obtain a ground effect.

In addition, as shown in FIG. 3, the unitary ground plate 71 includes an attaching hole portion 71B for attaching the insulating plate 62 thereto. The attaching hole portion 71B is situated between the ground pieces 71A in the longitudinal direction of the terminal 61. The attaching hole portion 71B has an approximate rectangular shape extending in the longitudinal direction of the terminal 61.

In addition, the attaching hole portion 71B has a slightly narrower width at a portion on a side thereof where the lower contacting portions 61A-2 and 61B-2 are situated (an approximate lower half portion) than a width at a portion on a side thereof where the upper contacting portions 61A-1 and 61B-1 are situated (an approximate upper half portion). Further, the attaching hole portion 71B has a slightly narrower width than the width of the protruding portion 62E at the approximate lower half portion thereof and has a slightly wider width than the width of the protruding portion 62E at the approximate upper half portion thereof.

As shown in FIG. 3, the unitary ground plate 71 includes an engaging piece 71C at an upper portion and a lower portion thereof in the longitudinal direction of the terminal 61 on each of both end portions and a central portion on the terminal disposing surface thereof. The engaging piece 71C is cut and bent toward an opposite direction of the blade 60 and has a shape like an arm.

In the embodiment, the engaging piece 71C situated at the upper portion of the unitary ground plate 71 is referred to as an upper engaging piece 71C-1, while the engaging piece 71C situated at the lower portion of the unitary ground plate 71 is referred to as a lower engaging piece 71C-2. In a case there is no need to distinguish between the upper engaging piece 71C-1 and the lower engaging piece 71C-2, the upper engaging piece 71C-1 and the lower engaging piece 71C-2 may be referred to as "engaging piece 71C" inclusively.

As shown in FIG. 3, the upper engaging piece 71C-1 extends in the lower direction and the lower engaging piece 71C-2 extends in the upper direction. As described later, when the blade assembly 50 is held by the upper holding member 20 and the lower holding member 30, the engaging piece 71C engages an engaged portion provided in each of the upper holding member 20 and the lower holding member 30. Thus it is possible to prevent the blade assembly 50 from coming off from the upper holding member 20 and the lower holding member 30.

The unitary ground plates 71 are combined next to each other through the connecting portions 72 having the narrow shape situated at two locations on an edge portion extending in the longitudinal direction of the terminal 61 thereof. Thus the ground plate 70 is formed as a single metal plate.

Next, a process of manufacturing the blade assembly 50 will be explained. First, the plurality of the terminals 61 extending in straight and supported by a carrier is disposed in a mold with the equal intervals. Next, the plurality of the terminals 61 and the insulating plate 62 made from the synthetic resin are formed integrally by injecting a melting resin in the mold. Thus the blade 60 shown in FIGS. 4(A) and 4(B) is manufactured. The carrier is cut off after the blade 60 is manufactured.

Next, the unitary ground plate 71 is attached closely to the blade 60. The protruding portion 62E of the blade 60 is inserted into the approximate upper half portion of the corresponding attaching hole portion 71B, in other words, into the portion of the attaching hole portion 71B having the slightly wider width than the width of the width of the protruding portion 62E.

Then, the blade 60 is slid in the lower direction maintaining a state that the attached surface of the blade 60 is attached closely to the plate surface of the unitary ground plate 71 so that the protruding portion 62E is pressed into the approximate lower half portion of the attaching hole portion 71B or into the portion having the slightly narrower width than the width of the protruding portion 62E in the longitudinal direction of the terminal 61. As a result, an inner edge of the approximate lower half portion of the attaching hole portion 71B cuts into an outer edge of the protruding portion 62E. Thereby the unitary ground plate 71 is attached to the blade 60. In a similar way, all of the blades 60 are attached to the corresponding unitary ground plates 71, respectively. Thus the process of manufacturing the blade assembly 50 is completed.

It is not necessary that the above-mentioned process of manufacturing the blade assembly 50 is performed followed by a process of assembling the connector 1. In the embodiment, the plurality of the blade assemblies 50 has been already manufactured as one of parts for configuring the connector 1 when the connector 1 is assembled.

Next, the process of assembling the connector 1 will be explained. FIG. 5 is a perspective view showing the process of assembling of the connector 1. FIG. 6 is a sectional view showing the connector 1 taken along a line 6-6 in FIG. 2(C). FIG. 7(A) is a sectional view showing the connector 1 taken along a line 7(A)-7(A) in FIG. 2(A) and FIG. 7(B) is a sectional view showing the connector 1 taken along a line 7(B)-7(B) in FIG. 2(A).

First, as shown in FIGS. 5 and 6, the two blade assemblies 50 are pressed into the retaining portion 32 of the lower holding member 30. The blade assembly 50 enters the retaining portion 32 from a side where the lower contact portions 61A-2 and 61B-2 are situated thereof, through an upper opening portion of the retaining portion 32. Note that both of the blade assemblies 50 face to each other with the terminal disposing surfaces thereof. Therefore, two of the blade assemblies 50 are held with the lower holding member 30 at lower portions thereof.

When the blade assemblies 50 are held with the lower holding member 30, as shown in FIG. 6, the elongated protruding portion 31B provided on a separating wall portion 31 of the lower holding member 30 is inserted into the lower holding groove 62C-2 of each of the blades 60 in the longitudinal direction of the terminals 61 or the height direction of the connectors.

The holding protruding portions 62C-2A and 62C-2B provided in the lower holding groove 62C-2 sandwich and hold the elongated protruding portion 31B in the width direction of the connectors, or the terminal disposing direction. Further, the lower engaging piece 71C-2 of the blade assembly 50 engages the engaged portion (not shown) in the height direction of the connectors. The engaged portion is formed as a tiered portion in an inner surface of the retaining portion 32 of the lower holding member 30. Thus it is possible to prevent the blade assembly 50 from coming off from the lower holding member 30. Accordingly, the lower holding member 30 is able to hold the blade assembly 50.

As shown in FIG. 6, the blade assembly 50 thus pressed into the lower holding member 30 penetrates the retaining portion 32. In addition, the blade assembly 50 protrudes the lower portion thereof, that is, the portion where the contact portions 61A-2 and 61B-2 are situated thereof, from a lower end portion of the lower holding member 30.

In the embodiment, the blade assembly 50 is pressed into the lower holding member 30 to a state that the lower edge portion thereof reaches to an approximate the same position with a lower end portion of an end wall portion 33 in the height direction of the connectors. Further, as shown in FIG. 5, a lower receiving opening 36 is provided between the lower portions of the blade assemblies 50. The receiving opening 36 receives a central wall portion 112 (described later) of the lower connector 3 when the lower connector 3 is connected to the connector 1.

Next, as shown with an arrow P1 in FIG. 5, the blade assembly 50 is inserted into the intermediate portion 40 from a side where a lower opening portion of the intermediate portion 40 is situated, thereby attaching the blade assembly 50 into the intermediate portion 40.

Next, as shown with an arrow P2 in FIG. 5, the blade assembly 50 is pressed into the retaining portion 22 of the upper holding member 20 from the upper edge portion thereof through a lower opening portion of the retaining portion 22. Therefore, the blade assembly 50 is held with the upper holding member 20 at an upper portion thereof.

Similar to a case that the blade assembly 50 is held with the lower holding member 30 at the lower portion thereof, in the retaining portion 22, the elongated protruding portion 21B provided on a separating wall portion 21 of the upper holding member 20 is inserted into the upper holding groove 62C-1 of each of the blades 60 in the height direction of the connectors. Then, as shown in FIG. 6, the holding protruding portions 62C-1A and 62C-1B provided in the upper holding groove 62C-1 sandwich and hold the elongated protruding portion 21B in the width direction of the connectors, or the terminal disposing direction.

Further, as shown in FIGS. 7(A) and 7(B), the upper engaging piece 71C-1 of the blade assembly 50 engages an engaged portion 22A provided in an inner surface of the retaining portion 22. Thus it is possible to prevent the blade assembly 50 from coming off from the lower holding member 20. Accordingly, the upper holding member 20 is able to hold the blade assembly 50. Thereby, the process of assembling of the connector 1 is completed.

As shown in FIGS. 6, 7(A) and 7(B), the blade assembly 50 thus inserted into the upper holding member 20 penetrates the retaining portion 22. In addition, the upper portion of the blade assembly 50, that is, the portion where the contact portions 61A-1 and 61B-1 are situated, protrudes from the upper end portion of the upper holding member 20. In the embodiment, the blade assembly 50 is inserted into the upper holding member 20 in a state that the upper edge portion thereof reaches to an approximate the same position with an upper end portion of an end wall portion 23 in the height direction of the connectors.

Further, as shown in FIGS. 7(A) and 7(B), an upper receiving opening 26 is provided between the upper portions of the blade assemblies 50. The receiving opening 26 receives a central wall portion (not shown) of the upper connector 2 when the upper connector 2 is connected to the connector 1.

Configurations of the upper connector 2 and the lower connector 3 as the mating connectors of the connector 1 will be explained next. The configuration of the lower connector 3 will be explained mainly since the upper connector 2 has basically the same configuration as that of the lower connector 3 inverted upside down as shown in FIG. 1. The configuration of the upper connector 2 will be explained only about differences from the lower connector 3.

As shown in FIG. 1, the lower connector 3 includes a housing 110 with an approximate rectangular shape and made from a synthetic resin; a plurality of terminals 120 disposed and held by the housing 110 in a longitudinal direction of the housing 110; and a plurality of fixing members 130 made from metal, for fixing the lower connector 3 onto the circuit board.

As shown in FIG. 1, the housing 110 includes a receiving opening 111 for receiving the lower portion of the blade assembly 50 of the connector 1 when the lower connector 3 is connected to the connector 1. The receiving opening 111 opens toward in an upper direction of the housing 110. The housing 110 further includes the central wall portion 112 at a central portion of the receiving opening 111, extending over an approximate whole range of the receiving opening 111 in a width direction of the housing 110, that is, the width direction of the connectors.

The central wall portion 112 has an island shape. Accordingly, the receiving opening 111 is situated between the central wall portion 112 and a circumference wall of the housing 110, surrounding the central wall portion 112. The central wall portion 112 includes a terminal accommodating groove 112A at a position corresponding to the terminal 120 in a sidewall surface thereof. The terminal accommodating groove 112A extends from the lower to upper direction or the height direction of the connectors.

The terminal 120 is formed by bending a metal plate at an approximate right angle in a thickness direction thereof at a lower end side thereof. Thus the terminal 120 has an approximate L-shape. The terminal 120 extends in a direction perpendicular to both of the width direction and the height direction of the connectors, or the thickness direction of the connectors at a lower end portion thereof.

The lower end portion of the terminal 120 is formed as a connecting portion 121 for connecting to a corresponding circuit portion of the circuit board (not shown). In addition, the terminal 120 includes a contact portion 122 for contacting with the terminal 61 of the connector 1 in the receiving opening 111. The contact portion 122 is formed by bending an upper end portion of the terminal 120 so as to curve convexly in an extending direction of the connecting portion 121.

The terminal 120 working as a signal terminal is situated at a position corresponding to the signal terminal 61A of the connector 1 while the terminal 120 working as a ground terminal is situated at a position corresponding to the ground terminal 61B of the connector 1. As described later, when the lower connector 3 is connected to the connector 1, the terminal 120 contacting with the terminal 61 of the connector 1 deforms elastically toward the central wall portion 112, and the terminal accommodating groove 112A accommodates a portion of the terminal 120 thus deformed.

The terminal 120 is pressed into the housing 110 from the side of the contact portion 122 thereof first. The terminal 120 enters the housing 110 through a terminal inserting hole (not shown) provided in a bottom surface of the housing 110. Terminal holding grooves (not shown) sandwich and hold the terminal 120 with inner surfaces thereof, at both end edges of a lower portion of the terminal 120 extending in the height direction of the connectors. As shown in FIG. 1, the contact portion 122 is situated in the receiving opening 111, and the connecting portion 121 extends toward outside the lower connector 3 in the thickness direction of the connectors.

As shown in FIG. 1, the housing 110 further includes a guiding portion 114 as a recess portion opening toward the upper direction at both end portions of the upper end thereof in the width direction of the connectors. The guiding portion 114 receives the guided portion 34 of the connector 1 when the lower connector 3 is connected to the connector 1. The guiding portion 114 includes a guiding surface 114A having a slope in the width direction of the connectors and a guiding surface 114B having a slope in the thickness direction of the connectors at an opening edge portion thereof.

When the lower connector 3 is connected to the connector 1, the guiding surface 114A abuts against the guided surface 34A, and the guiding surface 114B abuts against the guided surface 34B to guide the connector 1 to a right connecting position in the width and thickness directions of the connectors, respectively, even though the lower connector 3 is slightly displaced from the right connecting position in the width direction or the thickness direction of the connectors. Accordingly, the connector 1 is guided to the right connecting position since the guiding portion 114 enters the guided portion 34 easily as the lower connector 3 is connected to the connector 1.

The receiving opening 111 includes the engaged portion (not shown) on an inner surface thereof at both edges in the width direction of the connectors. The engaged portion engages the hook portion 35 when the lower connector 3 is connected to the connector 1.

The fixing member 130 for fixing the lower connector 3 to the circuit board is provided at both end portions of a lower surface of the housing 110 in the width direction of the connectors. The fixing member 130 is made from a metal plate, and the fixing member 130 is mounted to the housing 110 by pressing a portion thereof into a holding slit portion having a slit shape (not shown). The holding slit portion is provided in the lower surface of the housing 110 and extends in the height direction of the connectors. Each of the fixing members 130 is provided at each of end portions of the housing 110 in the width direction of the connectors. The fixing members 130 situated at the end portions of the housing 110 include portions protruding toward the lower direction from the holding slit portion and extending in a direction away from each other, in the thickness direction of the connectors. The fixing member 130 is soldered to the circuit board at a lower edge portion thereof, thereby the lower connector 3 is fixed on the circuit board.

The upper connector 2 includes a housing 80; a terminal 90; and a fixing member 100. The upper connector 2 has basically the same configuration as that of the lower connector 3 inverted upside down.

Next, an operation of connecting the mating connectors 2 and 3 to the connector 1 will be explained.

First, the connector 1 is connected to the lower connector 3 mounted on the circuit board from the upper direction.

When the connector 1 is connected to the lower connector 3 from the upper direction, the central wall portion 112 of the lower connector 3 and the contact portion 122 of the terminal 120 enter the lower receiving opening 36 of the connector 1 from the lower direction. At the same time, the lower end portion of the two blade assemblies 50, that is, the contact portions 61A-2 and 61B-2 of the terminal 61, enters the receiving opening 111 of the lower connector 3 from the upper direction.

When the connector 1 and the lower connector 3 are slightly displaced from the right connecting position in the width or the thickness direction of the connectors, the guiding surface 114A of the lower connector 3 guides the guided surface 34A of the connector 1 in the width direction of the connectors, and the guiding surface 114B of the lower connector 3 guides the guided surface 34B of the connector 1 in the thickness direction of the connectors, respectively. Accordingly, the connector 1 is placed to the right connecting position with the lower connector 3.

The contact portion 122 of the terminal 120 of the lower connector 3 enters the lower receiving opening 36 of the connector 1, and then contacts with the contact portion 61A-2 or 61B-2 of the blade assembly 50 inside the lower receiving opening 36. The contact portions 61A-2 and 61B-2 press the contact portion 122 inward in the thickness direction of the connectors. Thus, the contact portion 122 displaces elastically to be accommodated in the terminal accommodating groove 112A.

Next, an upper surface of the central wall portion 112 of the lower connector 3 abuts against an upper surface of the separating wall portion (not shown) of the lower holding member 30, thereby preventing the central wall portion 112 from entering further and the operation of connecting the connector 1 to the lower connector 3 is thus completed.

When the connector 1 is connected to the lower connector 3, the hook portion 35 provided on the both edge portions of the connector 1 in the width direction of the connectors abuts against the inner surface of the receiving opening 111 with the engaging claw 35A thereof. As a result, the hook portion 35 deforms elastically in the width direction of the connectors. As the operation of connecting the connectors proceeds further and the engaging claw 35A reaches the engaged portion (not shown) formed as the tiered portion in the inner surface of the receiving opening 111, the engaging claw 35A is released from the elastic deformation and engages the engaged portion. Thus it is possible to prevent the connector 1 from coming off from the lower connector 3.

Next, the upper connector 2 mounted on the other circuit board is connected to the connector 1 from the upper direction. The operation of connecting the upper connector 2 to the connector 1 is basically the same with the operation of connecting the connector 3 to the connector 1 described above. The connector 1 does not include a hook portion for engaging the upper connector 2, and the upper connector 2 does not include an engaged portion to be engaged the connector 1 at the both end portion thereof in the width direction of the connectors, respectively. Accordingly, after the upper connector 2 is connected to the connector 1, the connector 1 and the upper connector 2 maintain a connecting state with a frictional force generated between the terminals in the connecting direction of the connectors.

In the embodiment, the blade assembly 50 having the plurality of the blades 60 attached to the single ground plate 70 has already been assembled when the connector 1 is assembled to be used. Thus, when the connector 1 is assembled, the plurality of the blades 60 can be attached to the holding members 20 and 30 at one time, with the simple operation of retaining the both end portions of the blade assembly 50 having the plurality of the blades 60 attached to the single ground plate 70 with the holding members 20 and 30. As a result, an operation of attaching the blades 60 does not have to be repeated as many times as the number of the blades 60.

In the embodiment, it is possible to shorten an amount of time required to assemble the connector 1 substantially, since a number of the operations of attaching the blades 60 can be reduced as compared to a case that the blades 60 are attached to the holding members 20 and 30 one by one.

In the embodiment, the blade assembly 50 includes the engaging piece 71C on the plate surface of the ground plate 70. The engaging piece 71C is situated at portions of the ground plate 70 being retained into the retaining portions 22 and 32 of the upper holding member 20 and the lower holding member 30, respectively. The retaining portions 22 and 32 include the engaged portions on the inner surface of the retaining portions 22 and 32, for engaging the engaging piece 71C in the height direction of the connectors. When the blade assembly 50 enters the retaining portions 22 and 32 with the edge portions thereof, the engaging piece 71C engages the engaged portions in the longitudinal direction of the terminal 61. Thus it is possible to prevent the blade assembly 50 from coming off from the upper holding member 20 and the lower holding member 30 more certainly.

In the embodiment, the edge portions of the blade assembly 50 are pressed into the retaining portions 22 and 32 of the upper holding member 20 and the lower holding member 30, respectively. Accordingly, it is possible to determine positions of the blade assembly 50 against the upper holding member 20 and the lower holding member 30, since the blade assembly 50 is fixed to the upper holding member 20 and the lower holding member 30.

In the embodiment, the intermediate portion 40 is disposed between the upper holding member 20 and the lower holding member 30. The intermediate portion 40 is supported with the upper holding member 20 and the lower holding member 30 from the upper direction and the lower direction, respectively. Accordingly, the blade assembly 50 does not have to be touched with a finger nor have a foreign object adhered thereto when the connector 1 is connected to the upper connector 2 and the lower connector 3. Therefore, it is also preferable, from an electrical point of view, that the connector 1 includes the intermediate portion 40.

The disclosure of Japanese Patent Application No. 2008-253267, filed on Sep. 30, 2008 is incorporated in the application by reference.

While the invention has been explained with reference to the specific embodiments of the invention, the explanation is illustrative and the invention is limited only by the appended claims.

What is claimed is:

1. An intermediate electrical connector for connecting two electrical connectors, comprising:

a blade assembly formed of a plurality of blades and a ground plate attached to the blades so that the ground plate holds the blades together;

a plurality of terminals disposed on a first surface of each of the blades and extending in parallel to each other; and a holding member for holding the blade assembly so that the first surfaces of the blades are aligned on a same plane.

2. The intermediate electrical connector according to claim 1, wherein said ground plate is attached to a second surface of each of the blades opposite to the first surface.

3. The intermediate electrical connector according to claim 1, wherein said holding member is arranged to hold the blade assembly at an edge portion of the blade assembly in a direction that the terminals extend.

4. The intermediate electrical connector according to claim 1, wherein said holding member includes a first holding member and a second holding member for holding both edge portions of the blade assembly.

5. The intermediate electrical connector according to claim 1, further comprising an intermediate portion disposed between the first holding member and the second holding member for covering the blade assembly.

6. The intermediate electrical connector according to claim 1, wherein said holding member includes a retaining portion for holding an edge portion of the blade assembly.

7. The intermediate electrical connector according to claim 6, wherein said blade assembly includes the edge portion fitted in the retaining portion.

8. The intermediate electrical connector according to claim 6, wherein said blade assembly includes an engaging portion disposed on the ground plate retained in the retaining portion.

9. The intermediate electrical connector according to claim 8, wherein said retaining portion includes an engaged portion on an inner surface thereof for engaging the engaging portion.

* * * * *